US005682999A

United States Patent [19]

Larson

[11] Patent Number: 5,682,999

[45] Date of Patent: Nov. 4, 1997

[54] NOVELTY BOX CONTAINING FOLDED ARTICLE

[75] Inventor: Seth L. Larson, Lakewood, Ohio

[73] Assignee: American Greetings Corporation, Cleveland, Ohio

[21] Appl. No.: 581,037

[22] Filed: Dec. 29, 1995

[51] Int. Cl.[6] ..... B65D 51/00; B65D 25/34; G09F 1/06

[52] U.S. Cl. ..... 206/768; 40/124.08; 40/539; 206/45.28; 229/116.1

[58] Field of Search ..... 206/457, 768, 206/45.28, 45.29, 459.5, 767; 40/124.1, 539, 124.08; 229/116.1, 92.8, 116.3, 116.4

[56] References Cited

U.S. PATENT DOCUMENTS

| | | | |
|---|---|---|---|
| 527,688 | 10/1894 | Hernshein | 206/768 |
| 1,499,891 | 7/1924 | Storer | 40/124.08 |
| 2,152,299 | 3/1939 | Arndt | 40/539 |
| 2,511,211 | 6/1950 | Klein et al. | 206/45.28 |
| 2,692,530 | 10/1954 | Gowland | 229/92.8 X |
| 3,995,388 | 12/1976 | Penick et al. . | |
| 4,548,352 | 10/1985 | Capo et al. | 229/116.1 |
| 4,763,427 | 8/1988 | Schrager . | |
| 4,833,802 | 5/1989 | Volkert . | |
| 4,949,482 | 8/1990 | Price . | |
| 5,096,751 | 3/1992 | Duchek . | |
| 5,317,823 | 6/1994 | Brunt, II . | |
| 5,586,659 | 12/1996 | Trubo | 206/768 |

FOREIGN PATENT DOCUMENTS

| | | | |
|---|---|---|---|
| 273153 | 6/1927 | United Kingdom | 206/45.29 |

*Primary Examiner*—Bryon P. Gehman
*Attorney, Agent, or Firm*—Calfee, Halter & Griswold LLP

[57] ABSTRACT

A novelty box having a hinged lid and containing a foldable article secured to the interior of the box and the lid so that as the lid is opened the foldable article is unfolded by the opening action of the lid to display the foldable article in an unfolded configuration. Graphics and/or messages on the exterior of the box may correspond to graphics and/or messages on the foldable article and/or the shape of the foldable article.

4 Claims, 6 Drawing Sheets

NOVELTY BOX CONTAINING FOLDED ARTICLE

FIELD OF THE INVENTION

The present invention pertains generally to personal greeting media and, in particular, to novelty items bearing greeting messages.

Background of the Invention

Novelty or gift boxes are relatively small boxes with fancifully decorated exteriors and sold empty as gifts. Such boxes are generally of very ordinary construction, having four walls and a bottom, and a removable or hinged lid. Such boxes are generally intended as functional decorative objects and may be adorned to convey messages or sentiments in the manner of greeting cards which are the traditional medium for conveying messages and sentiments in multiple dimensions. Greeting cards having structural elements in excess of the traditional two panels are popular and effective as communicative gifts. For example, U.S. Pat. No. 4,763,427 describes a greeting card which can be unfolded into a multi-dimensional configuration with an orthogonal base. There are many patents on multi-dimensional "pop-up" type greeting cards, such as U.S. Pat. Nos. 3,995,388, 4,833,802, 5,096,751 and 5,317,823 which disclose two or more cooperating panels which when unfolded or separated cause internal panels to unfold into a third dimension. However, these approaches have not combined the structures of a box with a folded article such as a multi-panelled card as a single gift or novelty item.

SUMMARY OF THE PRESENT INVENTION

The present invention is the novel combination of a novelty box which contains a foldable article attached to the interior of the box so that as the box is unfolded the article inside is drawn into an unfolded position.

In accordance with one aspect of the invention, a box is provided having an openable lid and containing a folded article attached to interior surfaces of the box and to an interior surface of the lid, the folded article being in a folded configuration when the box lid is closed and in an unfolded configuration when the box lid is open.

In accordance with another aspect of the invention, a folded article is attached to the interior of a box having an openable lid in a manner whereby the action of opening the lid of the box draws the folded article from a folded configuration into an unfolded configuration.

In accordance with another aspect of the invention, a method of presenting a greeting or message includes the steps of forming a folded article able to fit within a box-like container having a lid, and attaching one area the folded article to a surface of the interior of the box-like structure and a different area of the folded article to a surface of the lid in a manner whereby the folded article is urged into a folded position within the box when the box lid is in a closed position, and the folded article is drawn into an unfolded position by motion of the box lid as the box lid is opened.

These and other aspects of the invention are herein described in particularized detail with reference to the accompanying Figures.

Detailed Description of Preferred Embodiments

Figure 1:
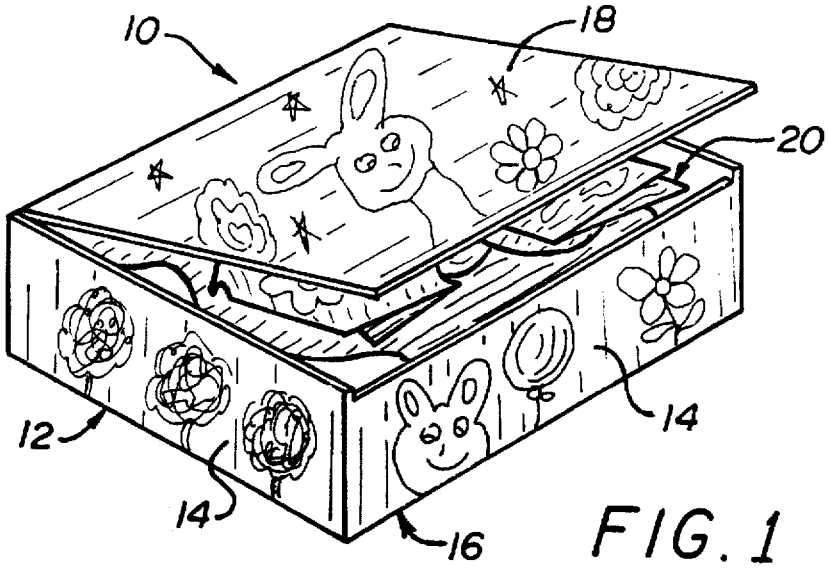
FIG. 1 is a perspective view of the Novelty Box of the present invention in a partially opened configuration.

As illustrated by each of the Figures, the invention is a novelty box containing a folded article, indicated collectively generally at 10, which includes a base box structure 12 having generally vertical side walls 14, a generally flat bottom 16, and an openable lid 18. In this embodiment, the openable lid 18 is hinged along a top edge of a side wall 14. Equivalent structures wherein the lid 18 is hingedly attached to a different side wall, in a different orientation relative to the front or top of the box, or not permanently attached to the box are contemplated by the invention.

Figure 2:
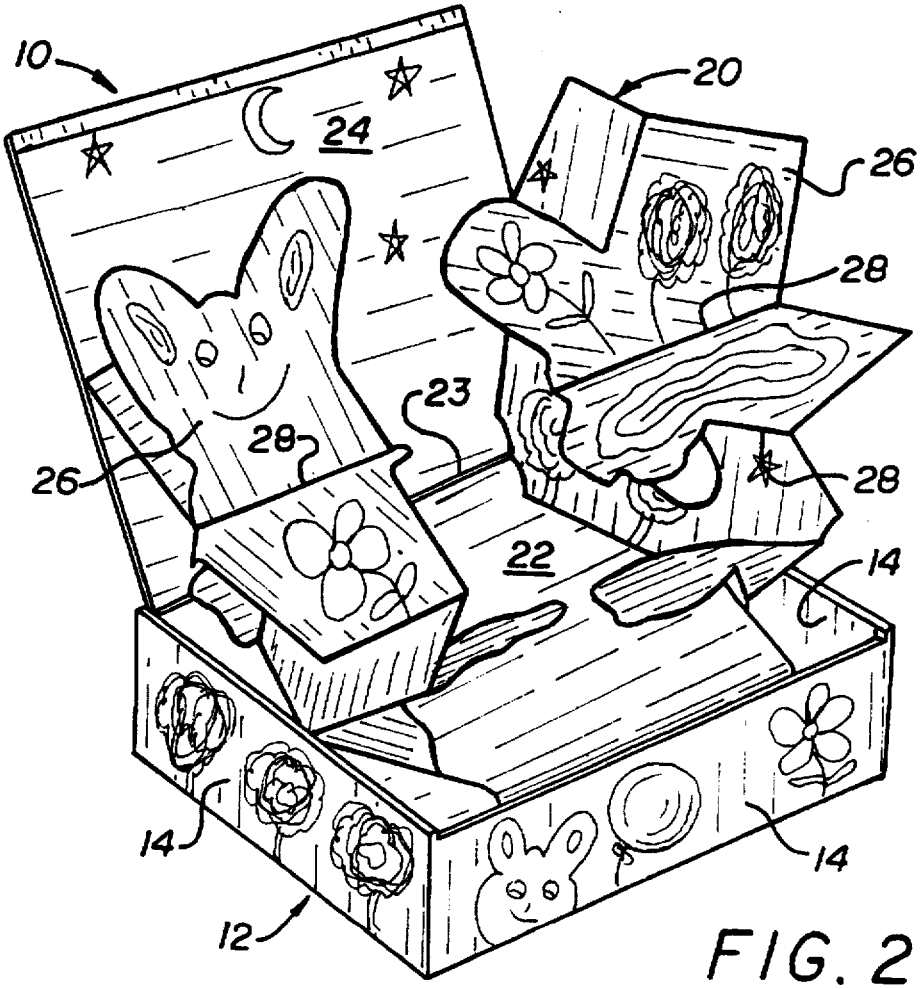
FIG. 2 is a perspective view of the Novelty Box of the present invention in a partially opened configuration.
Figure 3:
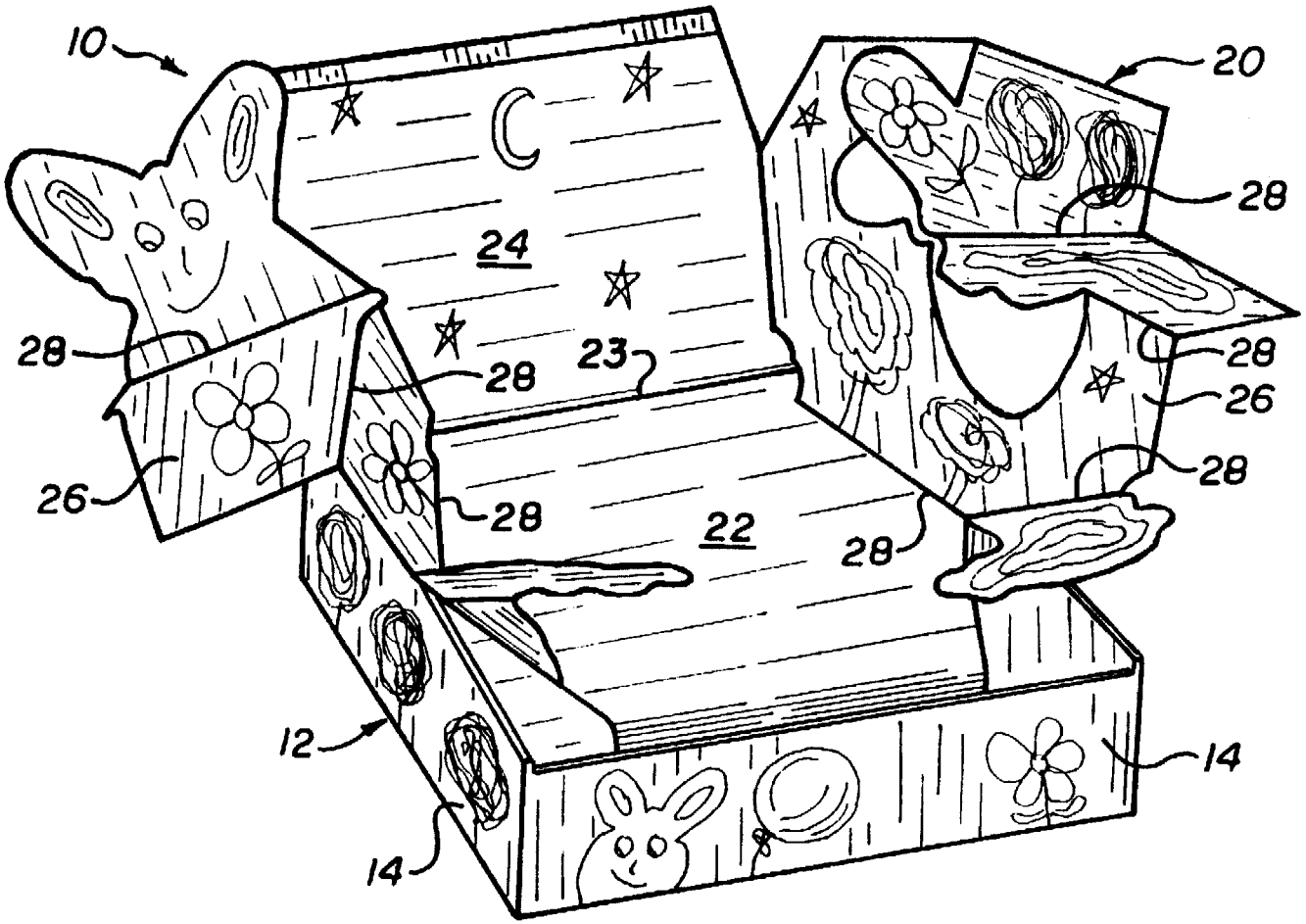
FIG. 3 is a perspective view of the Novelty Box of the present invention in a substantially opened configuration.
Figure 4:
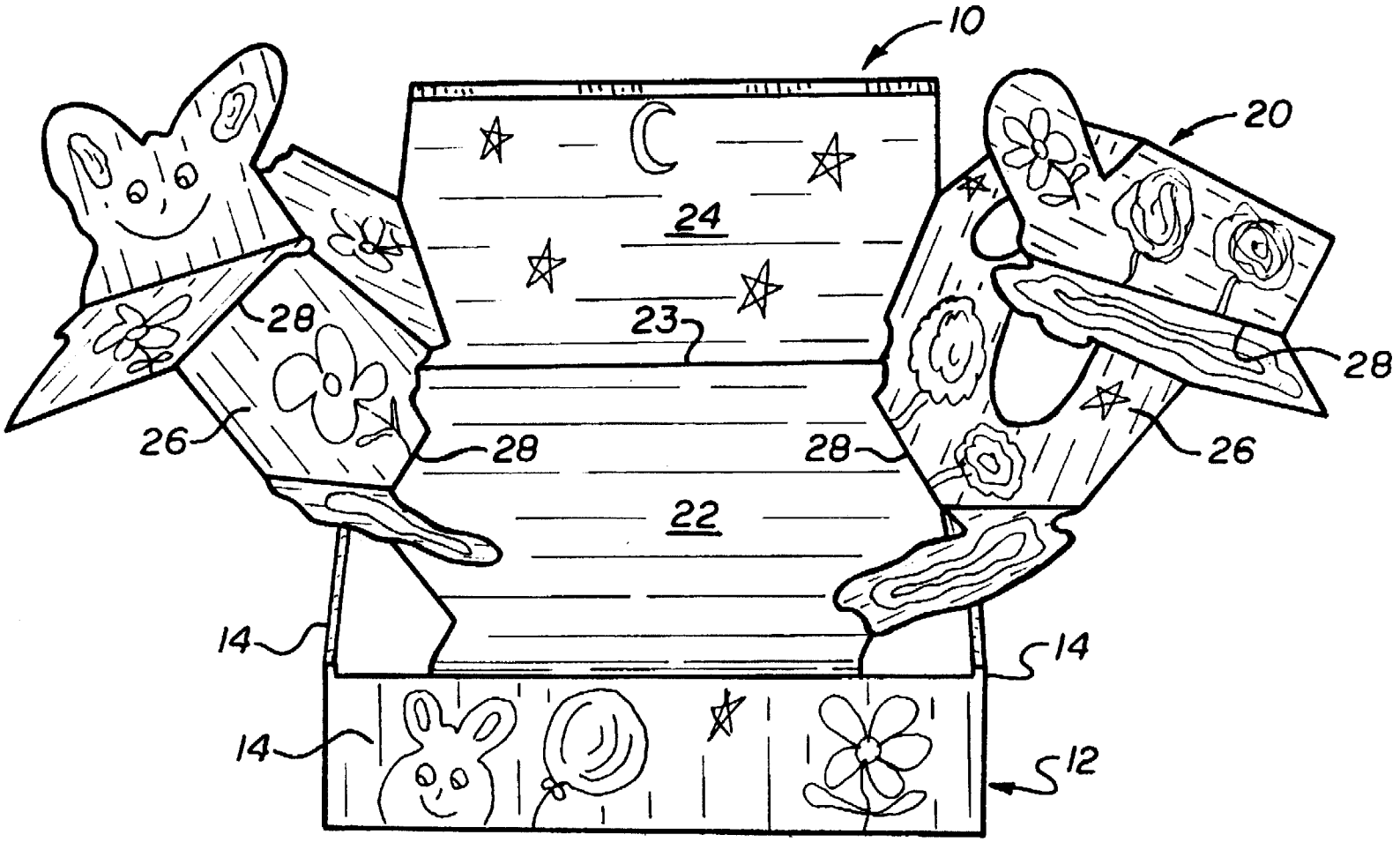
FIG. 4 is a perspective view of the Novelty Box of the present invention in a substantially opened configuration.

As further shown in each of the Figures, the box contains a folded article, indicated generally at 20, which is formed for example from card stock-type material or any foldable semi-rigid material. The folded article 20 may be cut to a desired pattern and scored or perforated and/or prefolded so that it is foldable into a configuration in which it fits within the internal cavity of the base box structure 12 as defined by the bottom, side walls and the lid. The depicted embodiment of the folded article 20 is therefore just one of a variety of shapes or styles executable in accordance with the principles of the invention. In the illustrated embodiment, the folded article 20 includes a main central panel 22, a lid panel 24 connected to the interior surface of lid 18 and to an edge of the main central panel along a score line 23, and panel projections 26 which extend from the main central panel 22 and/or the lid panel 24, by articulated attachment along a plurality of fold lines 28. The panel projections 26 are cut and folded to project in multiple dimensions from the main panel and the lid panel. For example, as shown in FIGS. 2–4, the panel projections 26 extend above panels 22 and 24 and laterally beyond the box side walls 14. Alternate cuts and/or additional elements projecting from or otherwise connected to the main central panel 22 or panel projections 26 of folded article 20 can be made to change the shape and appearance of the folded article 20 in an unfolded configuration. For example, additional elements such as adhesively attached "tip-on" panels or objects could be applied to any part of folded article 20 to add further dimension and detail to the product.

Figure 5:
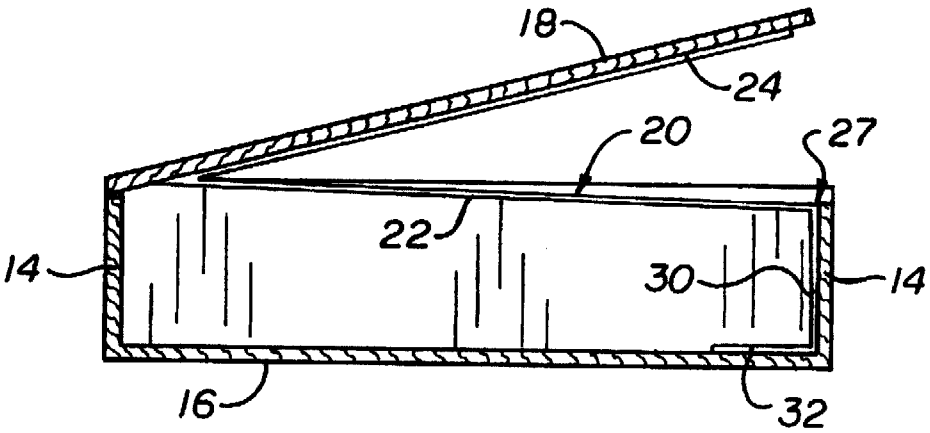
FIG. 5 is a side elevation sectional cross-sectional view of the Novelty Box of the present invention in a partially opened configuration.
Figure 6:
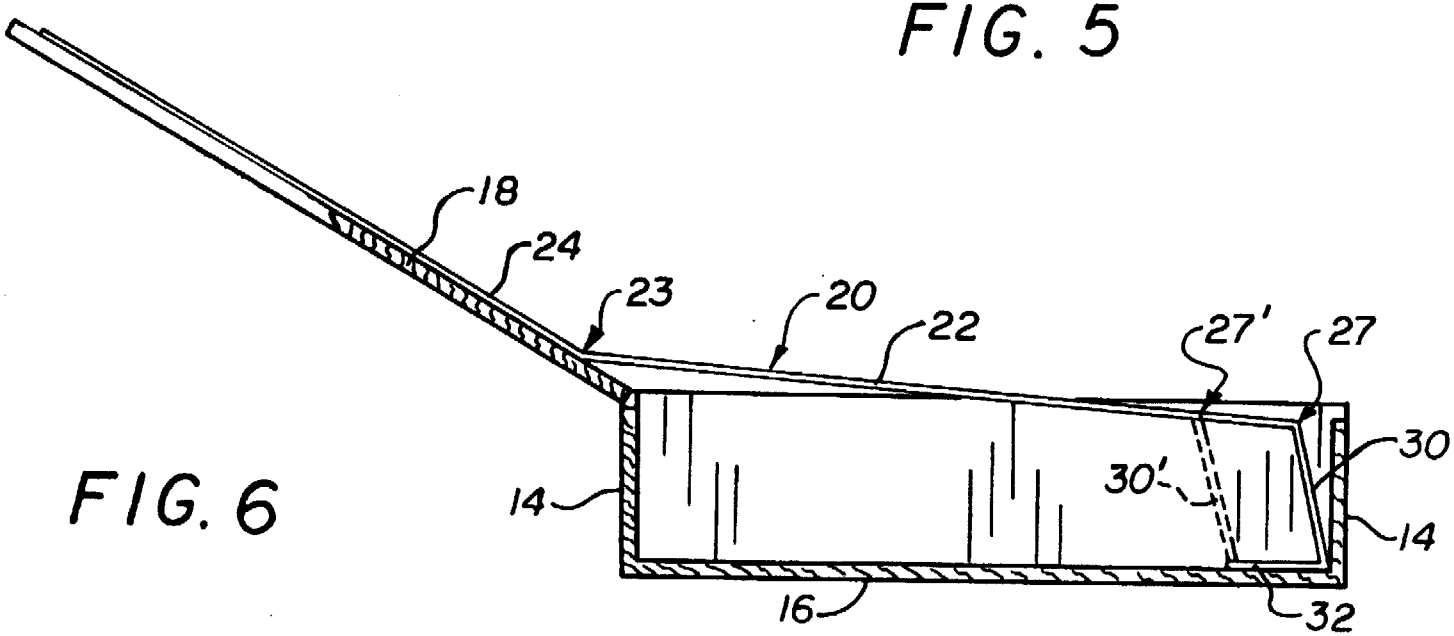
FIG. 6 is a side elevation section view of the Novelty Box of the present invention in a substantially opened configuration.
Figure 7:
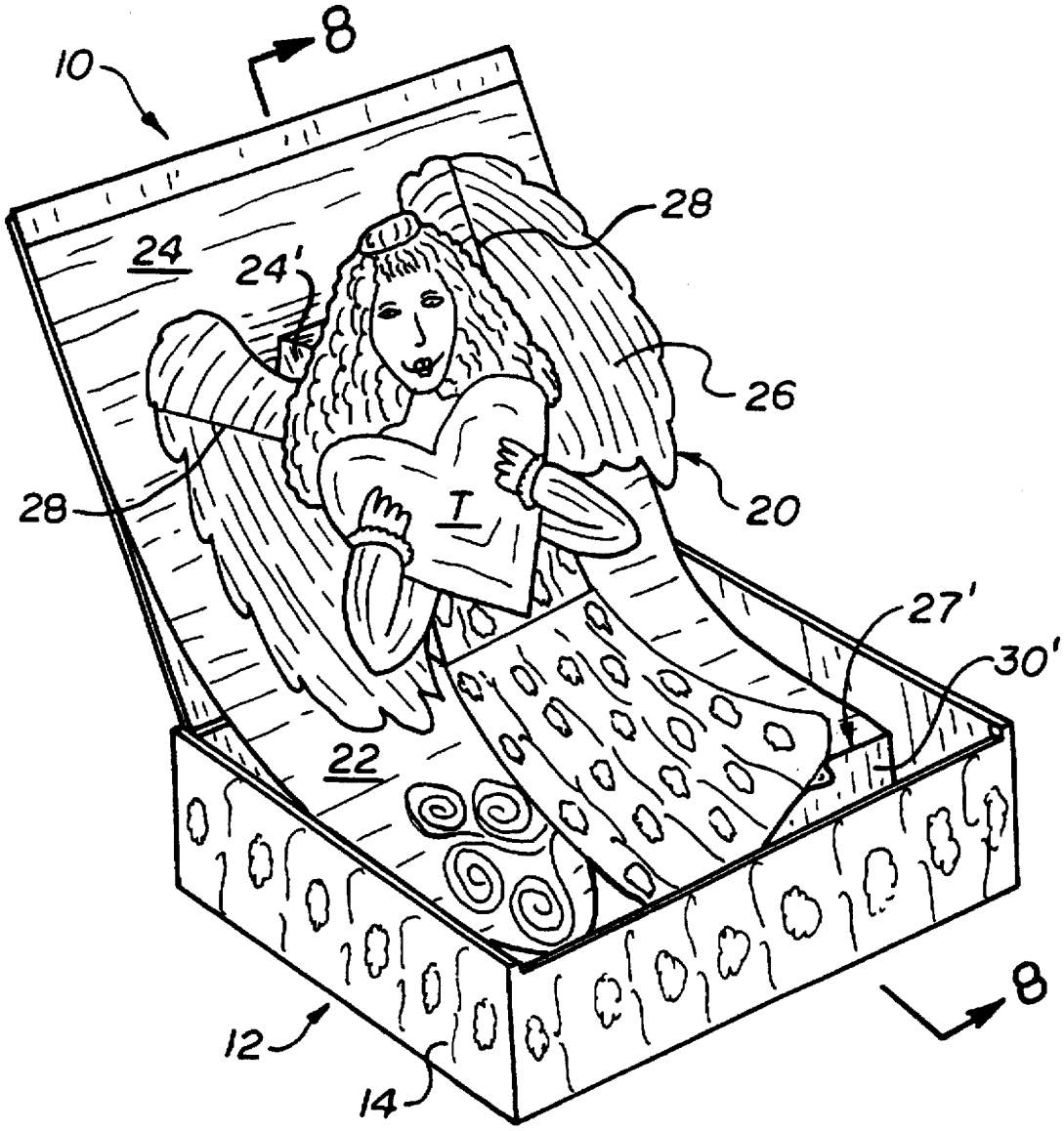
FIG. 7 is a perspective view of an alternate embodiment of the Novelty Box of the present invention.

As shown in FIGS. 5 and 6 (illustrated without panel projections 26 for clarity), lid panel 24 is attached to the interior of the box lid 18. Lid panel 24 may cover different degrees of the interior surface area of the box lid 18 dependent on the configuration of folded article 20. In many of the possible configurations of folded article 20 the panel projections 26 will project from both the main central panel 22 and the lid panel 24. Alternatively, panel projections 26 may extend only from one or the other of the main central panel or lid panel. The main central panel 22 is connected at a frontal end or edge along a score/fold line 27 to a generally vertically oriented flexing panel 30 connected at a bottom end to a base panel 32 which is attached, for example by adhesive, to an interior surface of bottom 16. Alternatively, score line 27' and flexing panel 30' may be spaced from the frontal side wall 14, whereby a cut-out portion of flexing panel 30' which is not scored along line 27' is free to remain substantially in the same plane of central panel 22 with the article unfolded, as shown in FIG. 7. By this configuration and attachment of folded article 20 relative to the interior of the base box structure 12 and lid 18, the folded article 20 is folded within the internal cavity of the box with the lid in a closed position, and drawn into an unfolded configuration by the movement of the lid relative to the interior of the box as the lid is opened. In other words, the "pop-up" articulation of folded article 20 is actuated by the opening of lid 18.

As shown in FIG. 6, the flexing action of panel 30 allows lid 18 to be moved into a fully opened position, thereby maximizing the unfolded extent of folded article 20 and avoiding separation or detachment of secured panels 32 and 24 from the interior surfaces of the box. In some embodiments, panel 30 can be secured to the interior surface of frontal side wall 14 in the position shown in FIG. 5 given adequate flexibility and range of motion of folded article 20 to allow complete opening of box lid 18 without a separation force exerted upon panel 30 through fold line 27.

Figure 8:
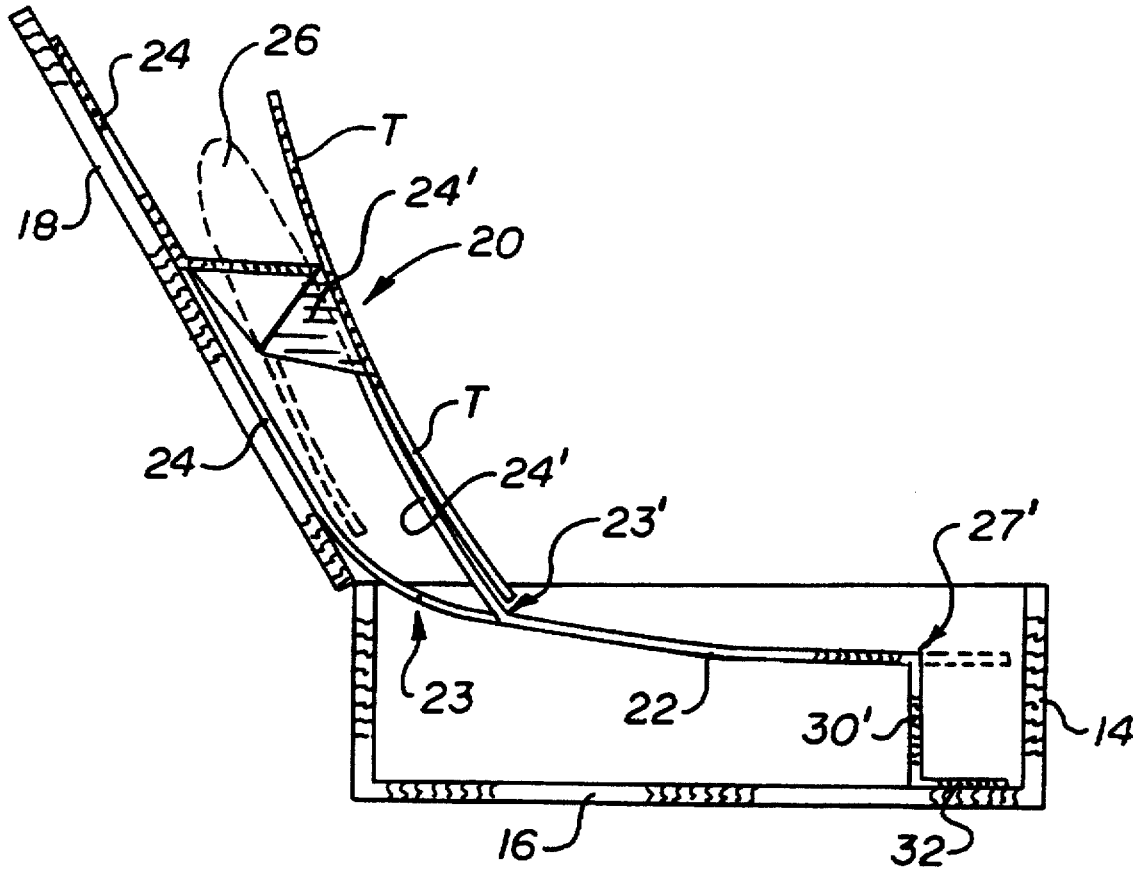
FIG. 8 is a side elevational cross-sectional view of the alternate embodiment of FIG. 7.

In the embodiment shown in FIGS. 7 and 8, a portion 24' of lid panel 24 is cut and folded to project forward from the interior of lid 18 and joined to the main central panel 22 at score line 23' to lift a portion of folded article 20 farther above the interior of the box as the lid is opened. A tip-on panel T may be affixed to lid panel projection 24' to further accentuate the relief dimensions of folded article 20. Panel projections 26 may also be tipped-on to projecting portion 24' of lid panel 24 and scored along lines 28 to fold with panels 24 and 22 (between lid panel projection 24' and tip-on panel T) as the box lid is closed. The added dimesions of the lid panel projection 24' and tip-on panels provide great flexibility to form folded article 20 in an infinite variety of configurations.

The exterior of the box may be adorned with graphics, indicia and/or messages. The folded article 20 may also be printed with graphics, indicia and/or messages which may or may not correspond to such on the exterior of the box, and which may or may not correspond to cut profiles of the multi-dimensional panel projections 26 of folded article 20.

The invention thus novelly provides the unobvious combination of a novelty box and a multi-dimensional dynamic structure contained in the box and actuated by opening the box, whereby the greeting impact upon the recipient is greatly enhanced. Although the invention has been described with respect to a particular embodiment, variations on the basic concept of the invention, such as for example without limitation, boxes of different dimensions and configurations and opening mechanics, folded article of different profiles, number of panels and score/fold lines, and type of graphics applied to the box and contents, are all contemplated by the inventors, within the purview of the invention and within the scope of the claims.

I claim:

1. A novelty box comprising a bottom, four side walls and an openable lid attached by a hinge to a top edge of the side walls which together form an internal cavity, a foldable article within the internal cavity, the foldable article comprising a main central panel which overlies the internal cavity of the box, and a lid panel which overlies the lid of the box, the main central panel connected to the lid panel along a fold line which is generally parallel to the lid hinge, and at least one laterally projecting panel connected to the main panel along a fold line which is not parallel to the fold line which connects the main central panel to the lid panel, the main central panel secured to interior surfaces of the internal cavity of the box and the lid panel secured to an interior surface of the box lid in a manner whereby as the lid is opened about the hinge, the folded article is unfolded by the action of the lid.

2. A box comprising four sides, a bottom and a lid, the lid attached by a hinge to a top edge of one of the sides, a folded article dimensioned to fit within an internal cavity of the box when in a folded configuration, the folded article attached to an interior surface of the box and to an interior surface of the lid, the folded article including a main central panel and a lid panel connected together along a fold line which is generally parallel to the hinge, and laterally projecting panels attached to the main central panel and lid panel along fold lines which are not parallel to the hinge, whereby the folded article is unfoldable by movement of the lid relative to the sides and bottom of the box as the lid is opened about the hinged lid so that the main central panel overlies the internal cavity of the box, the lid panel overlies the lid of the box, and the laterally projecting panels extend laterally over lateral sides of the box.

3. A combined novelty box and folded article comprising a base box structure having a bottom and side walls which define a box cavity, a box lid hingedly secured to an edge of one of the sides, and a folded article dimensioned to fit within the box cavity when in a folded configuration, the folded article comprising at least one main central panel, at least two laterally projecting panels attached to and extending laterally from the main central panel and over the side walls when the folded article is in an unfolded configuration, each of said laterally projecting panels having a plurality of fold lines which cause the laterally projecting panels to unfold into a multi-dimensional configuration wherein each of the laterally projecting panels include at least two sub-panels positioned in different planes when unfolded, a base panel and a lid panel attached along fold lines to the main central panel, the base and lid panels secured to the internal cavity of the base box structure.

4. A folded article adapted for enclosure in a folded state in a box having a base, four sides and an openable lid, the folded article comprising a main central panel connected along a fold line to a lid panel configured for attachment to an interior surface of the openable lid of a box, and panel projections attached along fold lines to the main central panel and to the lid panel, the panel projections further comprising a plurality of score lines not parallel to the fold lines which connect the panel projections to the main central panel and to the lid panel, whereby the panel projections are operative to unfold relative to the main central panel and the lid panel into planes not generally parallel to either the main central panel or the lid panel when the box lid is opened.

* * * * *